US009779907B2

(12) United States Patent
Canfield

(10) Patent No.: US 9,779,907 B2
(45) Date of Patent: Oct. 3, 2017

(54) X-RAY TUBE HAVING A DUAL GRID AND DUAL FILAMENT CATHODE

(71) Applicant: VARIAN MEDICAL SYSTEMS, INC., Palo Alto, CA (US)

(72) Inventor: Bradley D. Canfield, Orem, UT (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 164 days.

(21) Appl. No.: 14/607,942

(22) Filed: Jan. 28, 2015

(65) Prior Publication Data

US 2016/0217965 A1 Jul. 28, 2016

(51) Int. Cl.

| | |
|---|---|
| ***H01J 35/06*** | (2006.01) |
| ***H01J 35/04*** | (2006.01) |
| ***H01J 9/04*** | (2006.01) |
| ***H01J 9/18*** | (2006.01) |
| ***H01J 35/14*** | (2006.01) |

(52) U.S. Cl.

CPC ..... *H01J 35/045* (2013.01); *H01J 9/042* (2013.01); *H01J 9/18* (2013.01); *H01J 35/06* (2013.01); *H01J 35/14* (2013.01); *H01J 2235/06* (2013.01); *H01J 2235/068* (2013.01)

(58) Field of Classification Search

None

See application file for complete search history.

(56) References Cited

U.S. PATENT DOCUMENTS 5,031,200 A * 7/1991 Plessis ..... H01J 35/14 378/136
6,259,193 B1 * 7/2001 Lipkin ..... H01J 1/18 313/271
8,396,185 B2 * 3/2013 Zou ..... A61B 6/032 378/112

(Continued)

FOREIGN PATENT DOCUMENTS

DE WO 2010146504 A1 * 12/2010 ..... H01J 35/045
EP 0 412 868 A1 2/1991

(Continued)

OTHER PUBLICATIONS

International Search Report dated Apr. 13, 2016 as received in Application No. PCT/US2016/015467.

(Continued)

*Primary Examiner* — Andrew Smyth
(74) *Attorney, Agent, or Firm* — Maschoff Brennan

(57) ABSTRACT

A cathode head can include: a first electron emitter filament having a first size; a first grid pair defining walls of a first filament slot having the first filament therein, each grid member of the first grid pair being electronically coupled to different voltage sources; a second electron emitter filament; and a second grid pair defining walls of a second filament slot having the first electron emitter therein, each grid member of the second grid pair being electronically coupled to different voltage sources. The first grid pair can have a first and second grid members; and the second grid pair can have the second grid member and a third grid member. The (Continued)

first grid member and third grid member are electronically coupled to the same voltage source and the second grid member being electronically coupled to a different voltage source.

24 Claims, 10 Drawing Sheets

(56) References Cited

U.S. PATENT DOCUMENTS

| | | | | |
|---|---|---|---|---|
| 9,142,381 | B2 * | 9/2015 | Onken | H01J 35/045 |
| 2002/0126798 | A1 * | 9/2002 | Harris | H01J 35/06 378/136 |
| 2011/0280363 | A1 * | 11/2011 | Zou | A61B 6/032 378/4 |

FOREIGN PATENT DOCUMENTS

| | | | | |
|---|---|---|---|---|
| FR | EP 0412868 | A1 * | 2/1991 | H01J 35/06 |
| WO | 2010/146504 | A1 | 12/2010 | |

OTHER PUBLICATIONS

Written Opinion of the International Searching Authority dated Apr. 13, 2016 as received in Application No. PCT/US2016/015467.

* cited by examiner

X-RAY TUBE HAVING A DUAL GRID AND DUAL FILAMENT CATHODE

BACKGROUND

X-ray tubes are used in a variety of industrial and medical applications. For example, X-ray tubes are employed in medical diagnostic examination, therapeutic radiology, semiconductor fabrication, and material analysis. Regardless of the application, most X-ray tubes operate in a similar fashion. X-rays, which are high frequency electromagnetic radiation, are produced in X-ray tubes by applying an electrical current to a cathode to cause electrons to be emitted from the cathode by thermionic emission. The electrons accelerate towards and then impinge upon an anode. The distance between the cathode and the anode is generally known as A-C spacing or throw distance. When the electrons impinge upon the anode, the electrons can collide with the anode to produce X-rays. The area on the anode in which the electrons collide is generally known as a focal spot.

X-rays can be produced through at least two mechanisms that can occur during the collision of the electrons with the anode. A first X-ray producing mechanism is referred to as X-ray fluorescence or characteristic X-ray generation. X-ray fluorescence occurs when an electron colliding with material of the anode has sufficient energy to knock an orbital electron of the anode out of an inner electron shell. Other electrons of the anode in outer electron shells fill the vacancy left in the inner electron shell. As a result of the electron of the anode moving from the outer electron shell to the inner electron shell, X-rays of a particular frequency are produced. A second X-ray producing mechanism is referred to as Bremsstrahlung. In Bremsstrahlung, electrons emitted from the cathode decelerate when deflected by nuclei of the anode. The decelerating electrons lose kinetic energy and thereby produce X-rays. The X-rays produced in Bremsstrahlung have a spectrum of frequencies. The X-rays produced through either Bremsstrahlung or X-ray fluorescence may then exit the X-ray tube to be utilized in one or more of the above-mentioned applications.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

Disclosed embodiments address these and other problems by improving X-ray image quality via improved electron emission characteristics, and/or by providing improved control of a focal spot size on an anode target. This helps to increase spatial resolution or to reduce artifacts in resulting images.

In one embodiment, a cathode head can include: a first electron emitter filament having a first size; a first grid pair defining walls of a first filament slot having the first electron emitter filament therein, each grid member of the first grid pair being electronically coupled to different voltage sources; a second electron emitter filament having a different second size spaced apart from the first electron emitter filament; and a second grid pair defining walls of a second filament slot having the first electron emitter therein, each grid member of the second grid pair being electronically coupled to different voltage sources. In one aspect, the first grid pair has a first grid member and a second grid member; and the second grid pair has the second grid member and a third grid member. In one aspect, the first grid member and third grid member are electronically coupled to the same voltage source and the second grid member being electronically coupled to a different voltage source.

In one embodiment, a method of manufacturing a cathode head can include: forming a cathode base; forming a ceramic insulator on the cathode base; forming a primary grid member on the ceramic insulator; and forming two filament slots through the primary grid member to the ceramic insulator so as to form three separate focusing grid members from the grid member, with one filament slot between adjacent and separate focusing grid members. In one aspect, the method can include brazing the cathode base to the ceramic insulator, and brazing the ceramic insulator to the primary grid member grid member. In one aspect, the method can include the formation of the two filament slots being by electric discharge machining (EDM). In one aspect, the method can include providing the ceramic insulator having two filament recesses preformed therein prior to being bonded to the primary grid member. In one aspect, the method can include forming the two filament slots so as to reveal the two preformed filament recesses in the ceramic insulator. In one aspect, the method can include coupling a cathode shield to the cathode base so as to be electrically coupled thereto so as to form a cathode shield cavity containing coil filaments in the two filament slots.

In one embodiment, a method of emitting electrons from a cathode to an anode can include: emitting electrons as a first electron beam from a first coil filament; focusing the first electron beam with a first focusing grid pair; ceasing electron emission from the first coil filament; emitting electrons as a second electron beam from a second coil filament; focusing the second electron beam with a second focusing grid pair; and ceasing electron emission from the second coil filament. In one aspect, the method can include emitting electrons from only one of the first or second coil filament at a time. In one aspect, the method can include steering the first electron beam from a first focal spot to a second focal spot with the first focusing grid pair; or steering the second electron beam from a third focal spot to a fourth focal spot with the second focusing grid pair. In one aspect, the method can include gating the first electron beam from reaching the anode with the first focusing grid pair; or gating the second electron beam from reaching the anode with the second focusing grid pair. In one aspect, the method can include focusing the first electron beam with a first focusing tab pair in a focusing direction orthogonal to the focusing by the first focusing grid pair; and focusing the second electron beam with a second focusing tab pair in a focusing direction orthogonal to the focusing by the second focusing grid pair.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1A:
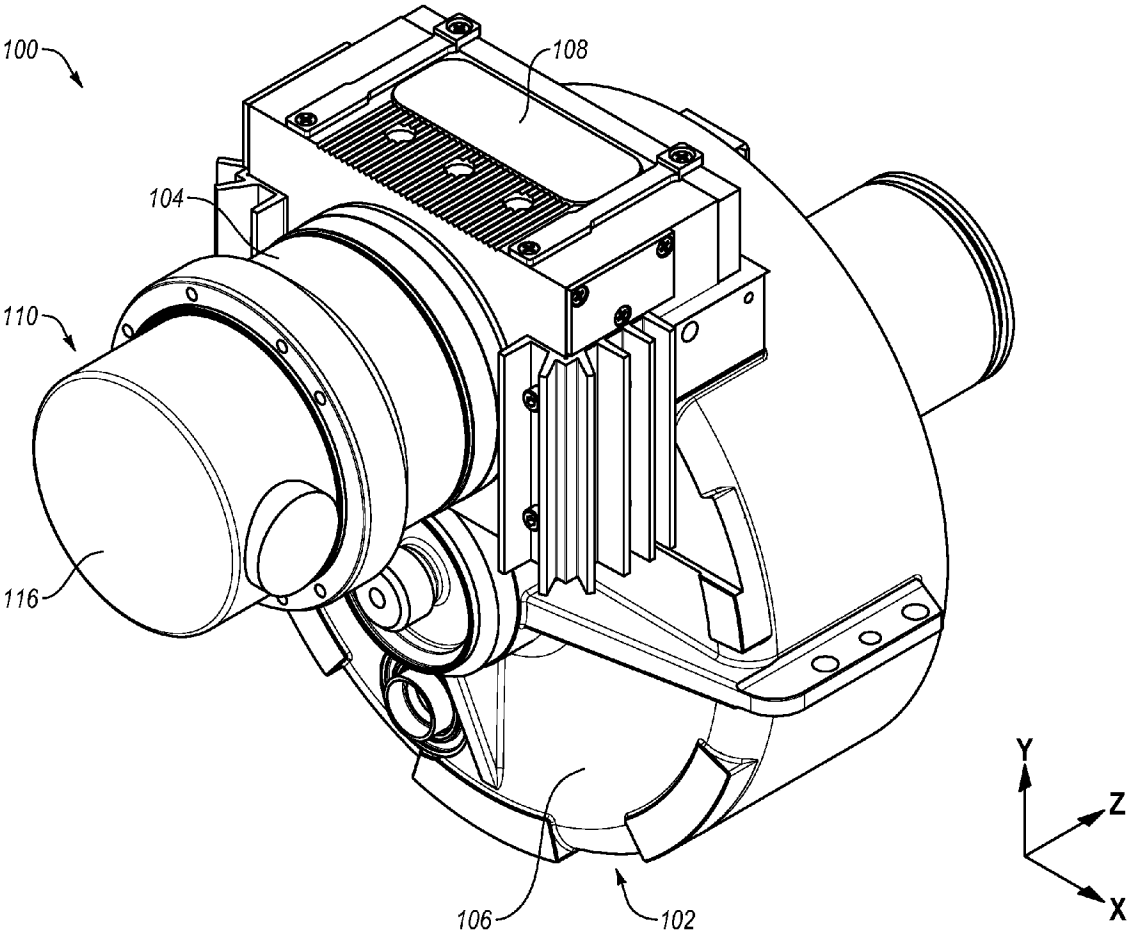
FIG. 1A is a perspective view of an example X-ray tube in which one or more embodiments described herein may be implemented.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Embodiments of the present technology are directed to X-ray tubes of the type having a vacuum housing in which a cathode and an anode are arranged. The cathode includes two electron emitters that emit electrons in the form of two electron beams that are each substantially perpendicular to the emitter from which the electrons are emitted, and the electrons of each beam are accelerated due to a voltage difference between the cathode and the anode so as to strike a target surface on the anode in an electron region referred to as a focal spot. Embodiments can also include an electron beam focusing component and focusing system that is configured to manipulate the electron beam(s) by focusing the electron beam(s) so as to alter the length and/or width dimensions of one or more focal spots from the electron beam(s). The focusing components and focusing system can also be used for steering the electron beam(s). Different embodiments utilize different configurations of such focusing components and focusing system, which can include: cathode head design, dual electronic focusing grids, dual focusing tabs, cathode head shield, and/or shield tabs. The X-ray tube can include focusing components and can selectively use the focusing components in different X-ray methodologies, such as in focusing, and optionally steering of electron beams.

Figure 1B:
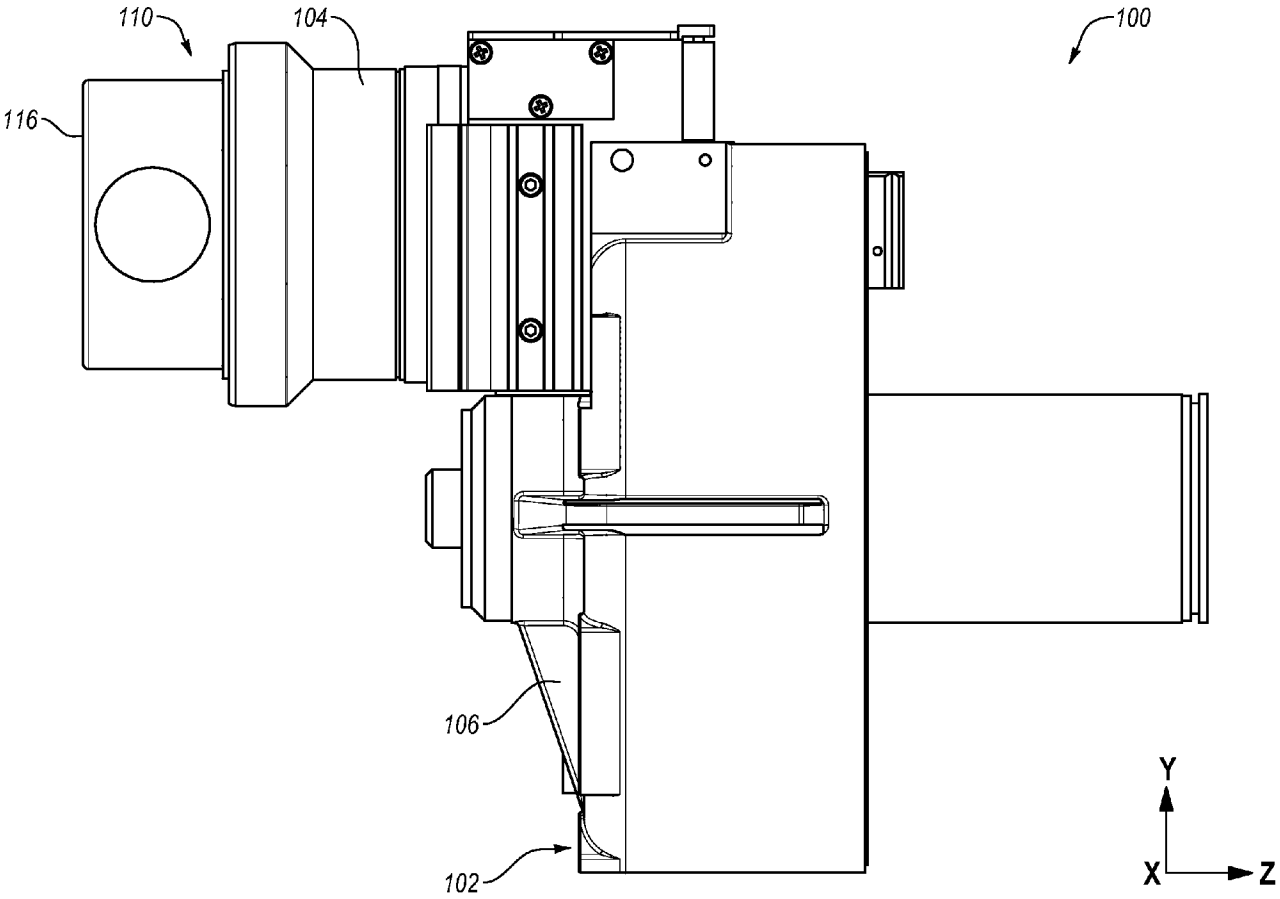
FIG. 1B is a side view of the X-ray tube of FIG. 1A.
Figure 1C:
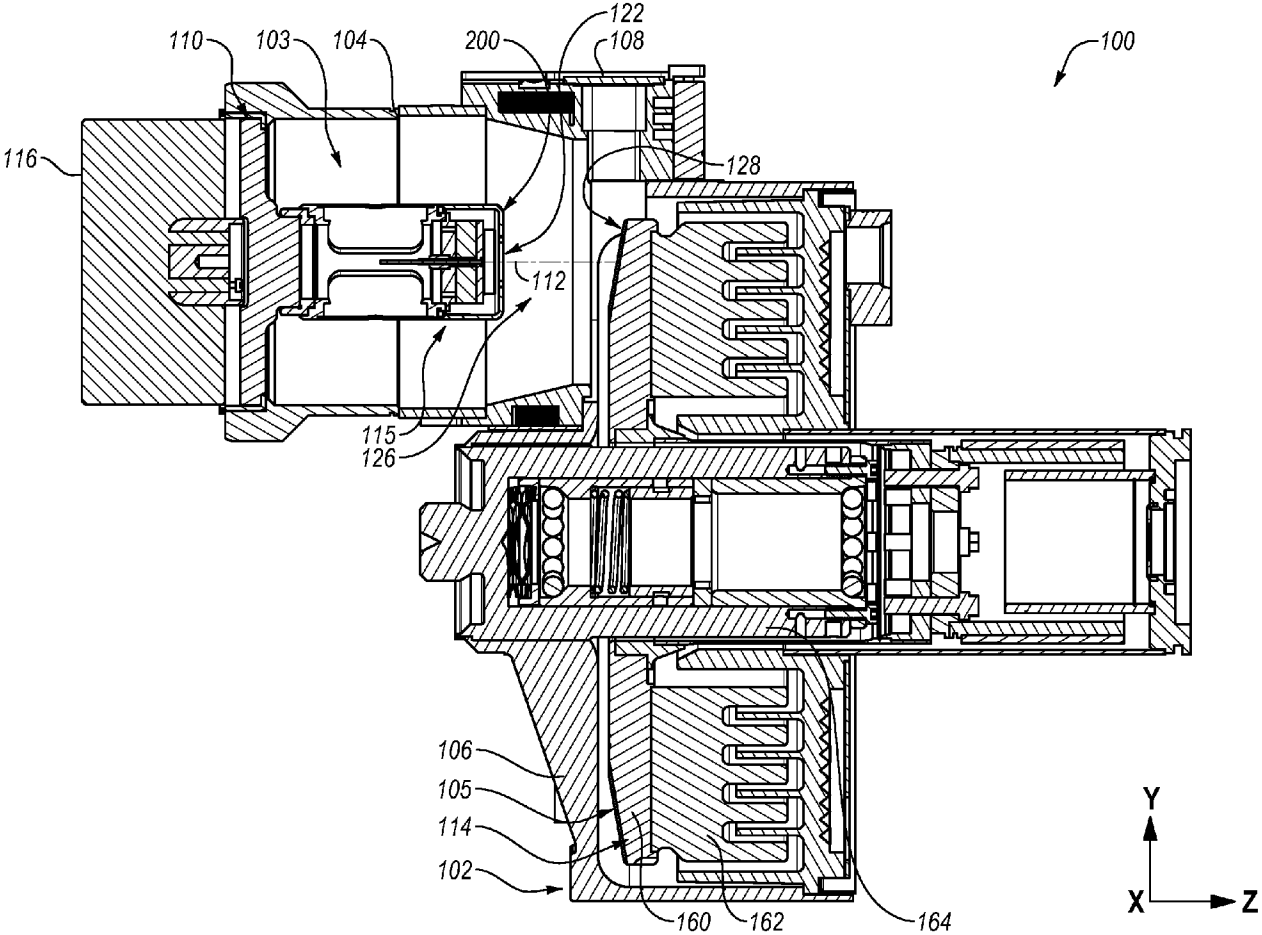
FIG. 1C is a cross-sectional view of the X-ray tube of FIG. 1A.

The embodiments can include an electron beam focusing component that includes a cathode head that has two electron emitter filaments with each filament being associated with two focusing grids (e.g., focusing grid pair), and optionally each filament being associated with two focusing tabs (e.g., focusing tab pair). The focusing grid pair can focus the electron beam in one direction, such as in the "X axis" direction, and the focusing tab pair can focus the electron beam in the other direction, such as the "Y axis" direction, or vice versa. Additionally, the focusing grid pair can be operated so as to steer the electron beam, such as by varying the voltage between the two focusing grids of the focusing grid pair. One example of an X-ray tube can have certain of these features—discussed in further detail below—is shown in FIGS. 1A-1C.

In general, example embodiments described herein relate to a cathode assembly with two coil filament electron emitters that can be used in substantially any X-ray tube, such as for example in long throw length X-ray tubes, short throw, or any throw length. When a suitable electrical current is passed through either of the coil filaments, the coiled emitting surfaces emit electrons that form an electron beam that propagates through an acceleration region to impinge upon a target surface of an anode at a focal spot.

In one embodiment, the ray-tube can be included in an X-ray system, such as a CT system or any medical radiographic system, and can include electron beam control. The X-ray tube can have high power with focusing upon emission from the coil filament. The X-ray tube can control the beam to a defined emission area for the beam or focal spot area.

In one embodiment, the cathode emits an electron beam from each coil filament, one at a time, that flows from the cathode toward the anode such that each beam spreads the electrons apart during transit, and the focusing grid pair and optionally the focusing tab pair focuses the electron beam to a defined focal spot. In one aspect, both the focusing grid pair and focusing tab pair provide a focusing effect on the electron beam. This allows for both beam length (e.g., Y axis) and beam width (e.g., X axis) focusing, wherein one of the focusing grid pair or focusing tab pair focuses in the length and the other of the focusing grid pair or focusing tab pair focuses in the width. In one aspect, the focusing tab pair can focus the length and the focusing grid pair can focus the width. In one aspect, the focusing tab pair focuses and fixes the length, and the focusing grid pair can actively modulate focusing of the width during electron beam emission. In one aspect, the length of the beam is fixed with the focusing tab pair, and multiple widths can be created with the focusing grid pair. The focusing grid pair can be used to set or change the width with a bias. Also, the individual grid members of the focusing grid pair can be modulated to move the beam in the X direction while maintaining the desired width. In one aspect, the focusing tab pair can focus the width and the focusing grid pair can focus the length. In one aspect, the focusing tab pair focuses and fixes the width, and the focusing grid pair can actively modulate focusing of the length during electron beam emission. In one aspect, the width of the beam is fixed with the focusing tab pair, and multiple lengths can be created with the focusing grid pair. The focusing grid pair can be used to set or change the length with a bias. Also, the individual grid members of the focusing grid pair can be modulated to move the beam in the Y direction while maintaining the desired length. This also allows for the ability of the X-ray tube to create a plurality of different types of focal spot sizes from one of the coiled emitters, where such changes of focusing and change of beam length and/or width can be performed during imaging, such as during a CT examination. Active focusing of electron beams from both coil emitters, one at a time, can be beneficial.

In one embodiment, the X-ray tube can include a multi-filament cathode head having focal spot position control and focusing. Each filament can be a separate electron emitter. The multiple filaments can include a large coil filament and a small coil filament, both in the cathode head and each having focusing components associated therewith. Each coil filament can be located within its own filament slot in the cathode head. Each coil filament can have its own electrical focusing grid pair, and each can have its own focusing tab pair. Each of the focusing grid pairs can include a first grid member (e.g., first grid electrode) and a second grid member (e.g., second grid electrode). The first grid member and second grid member of the focusing grid pair can have the same voltage in some instances, and each can have a different voltage for electrostatic beam shaping, focusing, steering, and manipulation in other instances. In one aspect, one of the grid members for a first coil filament can be used as one of the grid members for the second coil filament, and thereby each focusing grid pair can share a common grid member (e.g., the grid member between both coil filaments). Alternatively, each coil filament can have unique focusing grid members (e.g., unique focusing grid pair) that are not shared with the other coil filament. The voltages of the grid members can be modulated so as to provide a beam with a given dimension with limited emission from the outside of each coiled filament in an orthogonal dimension, where magnitude of the orthogonal dimension of the beam can be modulated with modulated voltage. The voltage difference between the two grid members for each coil filament can be used to modulate the orthogonal dimension. The tab pair can be used to set or modulate the given dimension.

In one embodiment, a method of emitting electrons from the cathode to anode can include: emitting electrons as a first electron beam from a first coil filament; focusing the first electron beam with a first focusing grid pair; ceasing electron emission from the first coil filament; emitting electrons as a second electron beam from a second coil filament; focusing the second electron beam with a second focusing grid pair; ceasing electron emission from the second coil filament. In one option, both the first and second focusing grid pairs share a common grid (e.g., common electrode). In one aspect, only one of the two coil filaments emits electrons at a time. However, it should be understood that it is possible for both coil filaments to emit electrons at the same time with beam focusing and/or steering occurring simultaneously. In one aspect, the method includes: focusing the first electron beam with a first focusing tab pair; and focusing the second electron beam with a second focusing tab pair.

In one embodiment, the first and second focusing grid pairs can in combination include three grid members with a coil filament between each of the grid members to provide two coil filaments. The sequence from one side to the other can be: a first grid member, a first coil filament, a second grid member, a second coil filament, and a third grid member. Here, the first grid member and third grid member can be wired to a common voltage supply and the second grid member can be wired to a different voltage supply. This configuration is beneficial because only one coil filament emits electrons at a time, so the focusing can be modulated with the first focusing grid pair (e.g., first grid member and second grid member) or the second focusing grid pair (e.g., second grid member and third grid member), depending on which foil filaments is activated to emit the electron beam. Accordingly, the first and third grid members can have a first voltage and the second grid member can have a different voltage. However, the voltage may be the same for all three grid members in some instances.

In one embodiment, each of the grid members can be electrostatically modulated for each coil filament in a manner that steers the electron beam. By changing the voltage differential between each grid member for a given coil filament, the electron beam can be effectively moved in one direction or the other opposite direction. This can occur during an X-ray procedure. For example, by reducing voltage of one grid (e.g., grid in the middle) and increase the voltage of the other grid (e.g., grid on the outside) then the voltage field can be changed so that the focusing function from the focusing grid pair aims the electrons toward a focal spot that shares an axis (e.g., aligned with) with the center of the cathode head. The opposite voltage differential can aim the electrons more towards a focal spot that is aligned with the edge of the cathode head. This allows for a switching grid supply to make the beam move back and forth by changing the grid member with the higher voltage from one to the other, where the electron beam is steered towards the grid member with the lower voltage. The voltage switching can be performed rapidly so that it appears to move the focal spot on the anode.

In one embodiment, both grid members of a focusing grid pair can have the voltage increased to a level where the focusing grid pair cuts off the electron emission, and shields the electrons from traversing to the anode. Accordingly, the grid pair can be electrified to a level to function as an electron beam gate and stops the electron beam from traversing to the anode.

In one embodiment, the focusing grid pair can focus in one direction (e.g., width) and the focusing tab pair can focus in an orthogonal direction (e.g., length) to the one direction. The focusing tab pair can be electrically coupled with the cathode base. In one optional aspect, the voltage of the cathode base can be modulated so as to modulate the voltage of the focusing tab pair in order to focus the electron beam. Otherwise, the focusing tab pair can be retained at the voltage of the cathode base. For example, the focusing tab pair can have each tab member with a lead extending through the ceramic to the cathode base. The focusing tab pair can be on the cathode head shield or they can be internal and mounted on the ceramic insulator. As such, either of the shield focusing tabs or internal focusing tabs can be electrically coupled with the cathode base. In one aspect, the focusing tabs can be grounded when the cathode base is grounded, such as when the X-ray tube is not Anode End Grounded, which can be used in an industrial tube which is anode hot (e.g., cathode grounded). In one aspect, the cathode base is not grounded; it is at the reference voltage. In one example, the cathode base is at a full kV (e.g., 80-140).

In one embodiment, each of the first focusing tabs of the first focusing tab pair for the first coil filament can have a different dimension compared to the dimension of each of the second focusing tabs of the second focusing tab pair for the second coil filament. However, the dimensions of the first and second focusing tab pairs may be the same. In still another alternative, each individual focusing tab member can have a unique dimension compared to the others so that the focusing tab members all have different dimensions. For the internal focusing tab members, the dimension can be from the ceramic insulator to the tip of the tab member. For the shield focusing tabs, the dimension can be from the perimeter of the shield aperture toward the tip of the tab member. Also, the dimension between tips of tab members of a focusing tab pair can be modulated for focusing, where closer tab tips have one focusing parameter, and tab tips of a focusing tab pair that are further away from each other can have a different focusing parameter. Closer tab tips can implement more focusing than tab tips that are further away from each other. The dimension of each tab and/or the dimension between tab tips of a focusing tab pair can be set during manufacture, but can be modulated in order to determine the optimal dimension(s) during design and iterative optimization. An iterative determination process can be used to optimize the dimension of the focusing tabs and/or dimension between the tab tips. Different X-ray machines may utilize different focusing tab dimensions and dimensions between tab tips. The dimension of the focusing tabs or dimension between the tab tips can create an effect in the voltage field that changes the trajectory and focusing of the electron beam as well as whether or not electrons on the coil filament are influenced by the voltage field.

In one embodiment, a method of manufacturing a cathode head can include: forming a cathode base; forming a ceramic insulator on the cathode base; forming a grid member on the ceramic insulator; and forming two filament slots through the grid member to the ceramic insulator to form three separate focusing grid members from the grid member, with one filament slot between the adjacent and separate focusing grid members. The cathode base, ceramic insulator, and grid member can be brazed or otherwise bonded or adhered together prior to any shaping of the grid member or forming of filament slots. The formation of the two filament slots can be by any time of machining, such as EDM. The ceramic insulator may or may not be machined with the filament slots. In one aspect, the ceramic insulator may already have two filament recesses preformed therein prior to being bonded to the grid member, so that the machining reveals the preformed filament recesses in the ceramic insulator. The cathode head shield can then be coupled to the cathode base so as to be electrically coupled thereto.

In one embodiment, each filament slot for the coiled filaments can have slot sidewalls that are at an angle from a plane of the cathode head surface (e.g., planar surface formed from the grid or all focusing grids) or from a plane of the cathode head base. That is, instead of the filament slots for the large and small coil filaments being parallel, the filament slots may be angled toward each other. While the entirety of the cathode head surface may not be planar, a plane can be formed by surfaces of the grid member that is perpendicular or orthogonal with respect to the electron beam. The angle of the slot sidewalls of the filament slots can be 90 degrees with respect to the cathode head surface plane or 0 degrees with respect to the slot sidewalls of the other filament slot. In one option, both slot sidewalls of a filament slot can have the same angle from the cathode head surface (e.g., cathode surface plane) or electron beam. In one option, all of the slot sidewall of all of the filament slots can have the same angle. In one option, the slot sidewalls are 90 degrees with respect to a cathode head plane or 0 degrees with respect to each other. In one option, the slot sidewalls of the different filament slots are at an angle different from 90 degrees, such as up to 80, 70, 60, 50, or 45 degrees from the cathode head plane, or 10, 20, 30, 40, or 45 degrees from each other. Both filament slots may be angled relative to the cathode head plane or each other, where the filament slots may parallel or may be angled to point to a common focal spot. That is, the slot sidewalls can be angled by the same amount so that each filament slot is angled at the same amount, but pointed toward a common target instead of both filament slots being parallel. This allows for converging filament slot geometries. In one aspect, both filament slots can be pointed toward a common focal point on the anode. In one option, one filament slot can be at 90 degrees relative to the cathode head plane and the other filament slot can be at an angle other than 90 degrees. In one option, one filament slot can be at a first angle and the other filament slot can be at a different angle.

In one embodiment, the cathode head can include two coil filaments as electron emitters, where the coil filaments are different sizes. The different sizes can be in coil length and/or coil diameter. Additionally, the coil filaments can have different coil turn pitch so as to be tighter coils or loser coils. In one example, the smaller coil filament can have tighter coils (e.g., tighter pitch or fine pitch) and the larger coil filament can have looser coils (e.g., looser pitch or course pitch). The cross-sectional diameter of each coil member can be the same size or different sizes.

FIGS. 1A-1C are views of one example of an X-ray tube 100 in which one or more embodiments described herein may be implemented. Specifically, FIG. 1A depicts a perspective view of the X-ray tube 100 and FIG. 1B depicts a side view of the X-ray tube 100, while FIG. 1C depicts a cross-sectional view of the X-ray tube 100. The X-ray tube 100 illustrated in FIGS. 1A-1C represents an example operating environment and is not meant to limit the embodiments described herein.

Generally, X-rays are generated within the X-ray tube 100, some of which then exit the X-ray tube 100 to be utilized in one or more applications. The X-ray tube 100 may include a vacuum enclosure structure 102 which may act as the outer structure of the X-ray tube 100. The vacuum enclosure structure 102 may include a cathode housing 104 and an anode housing 106. The cathode housing 104 may be secured to the anode housing 106 such that an interior cathode volume 103 is defined by the cathode housing 104 and an interior anode volume 105 is defined by the anode housing 106, each of which are joined so as to define the vacuum enclosure 102.

In some embodiments, the vacuum enclosure 102 is disposed within an outer housing (not shown) within which a coolant, such as liquid or air, is circulated so as to dissipate heat from the external surfaces of the vacuum enclosure 102. An external heat exchanger (not shown) is operatively connected so as to remove heat from the coolant and recirculate it within the outer housing. The cathode housing 104 and anode housing 106 or components associated therewith may include coolant passageways.

The X-ray tube 100 may also include an X-ray transmissive window 108. Some of the X-rays that are generated in the X-ray tube 100 may exit through the window 108. The window 108 may be composed of beryllium or another suitable X-ray transmissive material.

With specific reference to FIG. 1C, the cathode housing 104 forms a portion of the X-ray tube referred to as a cathode assembly 110. The cathode assembly 110 generally includes components that relate to the generation of electrons that together form an electron beam, denoted at 112. The cathode assembly 110 may also include the components of the X-ray tube between an end 116 of the cathode housing 104 and an anode 114. For example, the cathode assembly 110 may include a cathode head 115 having an electron emitter system, generally denoted at 122, disposed at an end of the cathode head 115. As will be further described, in disclosed embodiments the electron emitter system 122 can be configured as two coil filament electron emitters. When an electrical current is applied to the electron emitter system 122, the electron emitter system 122 is configured to emit electrons via thermionic emission, that together form a laminar electron beam 112 that accelerates towards the anode target 128.

Positioned within the anode interior volume 105 defined by the anode housing 106 is the anode 114. The anode 114 is spaced apart from and opposite to the cathode assembly 110. Generally, the anode 114 may be at least partially composed of a thermally conductive material or substrate, denoted at 160. For example, the conductive material may include tungsten or molybdenum alloy. The backside of the anode substrate 160 may include additional thermally conductive material, such as a graphite backing, denoted by way of example here at 162.

The cathode assembly 110 may additionally include an acceleration region 126 further defined by the cathode housing 104 and adjacent to the electron emitter system 122. The electrons emitted by the electron emitter system 122 form an electron beam 112 and enter and traverse through the acceleration region 126 and accelerate towards the anode 114 due to a suitable voltage differential. More specifically, according to the arbitrarily-defined coordinate system included in FIGS. 1A-1C, the electron beam 112 may accelerate in a z-direction, away from the electron emitter system 122 in a direction through the acceleration region 126.

The anode 114 may be configured to rotate via a rotatably mounted shaft, denoted here as 164, which rotates via an inductively induced rotational force on a rotor assembly via ball bearings, liquid metal bearings or other suitable structure. As the electron beam 112 is emitted from the electron emitter system 122, electrons impinge upon a target surface 128 of the anode 114. The target surface 128 is shaped as a ring around the rotating anode 114. The location in which the electron beam 112 impinges on the target surface 128 is known as a focal spot (not shown). Some additional details of the focal spot are discussed below. The target surface 128 may be composed of tungsten or a similar material having a high atomic ("high Z") number. A material with a high atomic number may be used for the target surface 128 so that the material will correspondingly include electrons in "high" electron shells that may interact with the impinging electrons to generate X-rays in a manner that is well known.

During operation of the X-ray tube 100, the anode 114 and the electron emitter system 122 are connected in an electrical circuit. The electrical circuit allows the application of a high voltage potential between the anode 114 and the electron emitter system 122. Additionally, the electron emitter system 122 is connected to a power source such that an electrical current is passed through the electron emitter system 122 to cause electrons to be generated by thermionic emission. The application of a high voltage differential between the anode 114 and the electron emitter system 122 causes the emitted electrons to form an electron beam 112 that accelerates through the acceleration region 126 towards the target surface 128. Specifically, the high voltage differential causes the electron beam 112 to accelerate through the acceleration region 126. As the electrons within the electron beam 112 accelerate, the electron beam 112 gains kinetic energy. Upon striking the target surface 128, some of this kinetic energy is converted into electromagnetic radiation having a high frequency, i.e., X-rays. The target surface 128 is oriented with respect to the window 108 such that the X-rays are directed towards the window 108. At least some portion of the X-rays then exit the X-ray tube 100 via the window 108.

Optionally, one or more electron beam manipulation components can be provided. Such devices can be implemented so as to "focus," "steer" and/or "deflect" the electron beam 112 before it traverses the region 126, thereby manipulating or "toggling" the dimension and/or the position of the focal spot on the target surface 128. That is, the components configured to "focus," "steer" and/or "deflect" the electron beam may be located on the cathode head 115. Additionally or alternatively, a manipulation component or system can be used to alter or "focus" the cross-sectional shape (e.g., length and/or width) of the electron beam and thereby change the shape and dimension of the focal spot on the target surface 128. In the illustrated embodiments electron beam focusing and steering are provided by way of focusing grid pairs 210 and focusing tab pairs 220, which are described in more detail herein.

FIG. 1C shows a cross-sectional view of an embodiment of a cathode assembly 110 that can be used in the X-ray tube 100 with the electron emitter system 122 and focusing system 200 described herein. As illustrated, a throw path between the electron emitter system 122 and target surface 128 of the anode 114 can include the acceleration region 126.

The focusing system 200 can include various combinations of focusing grid pairs 210 and focusing tab pairs 220 and are disposed on the cathode head 115 so as to impose electrical fields on the electron beam and spatial limitations on the electron beam so as to focus and optionally steer the beam. Examples of the focusing system and components thereof are shown in FIGS. 2A-2B, 3A-3C, 4, 5, 6, and 7A-7B.

In the embodiments, the focusing system 200 is implemented as two different focusing grid pairs 210*a*, 210*b*, which provides a first focusing grid pair 210*a* for the first coil filament 230 (e.g., large coil filament) and a second focusing grid pair 210*b* for a second coil filament 240 (e.g., small coil filament). Additionally, the focusing system can be implemented with two different focusing tab pairs 220*a*, 220*b*, which provides a first focusing tab pair 220*a* for the first coil filament 230 and a second focusing tab pair 220*b* for the second coil filament 240. The two focusing grid pairs 210*a*, 210*b* are each configured to (a) focus in one direction perpendicular to the beam path, and optionally (b) to steer the beam in that same direction perpendicular to the beam path. The two focusing tab pairs 220*a*, 220*b* are each configured to (a) focus in an orthogonal direction perpendicular to the beam path and the one direction. The "focusing" provides a desired focal spot shape and size, and the "steering" effects the positioning of the focal spot on the anode target surface 128.

Figure 2B:
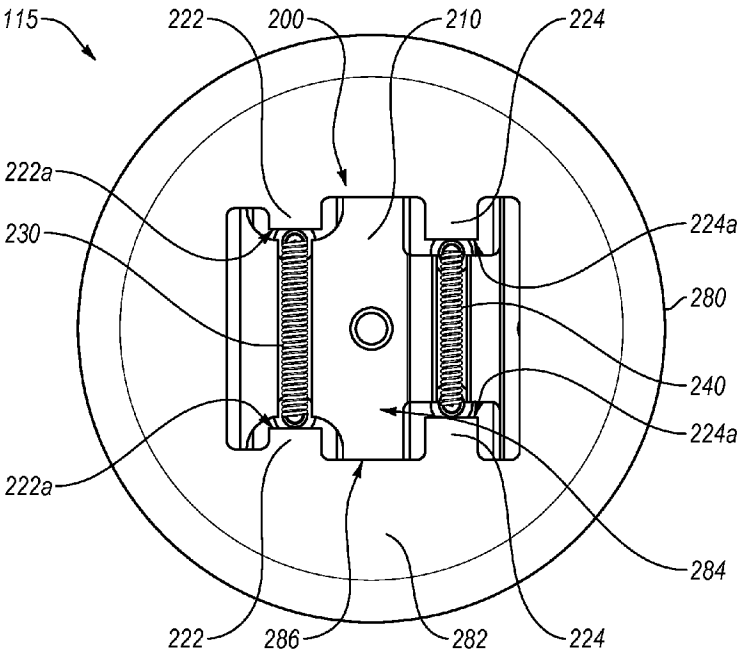
FIG. 2B is a top view of an embodiment of a cathode head.
Figure 2A:
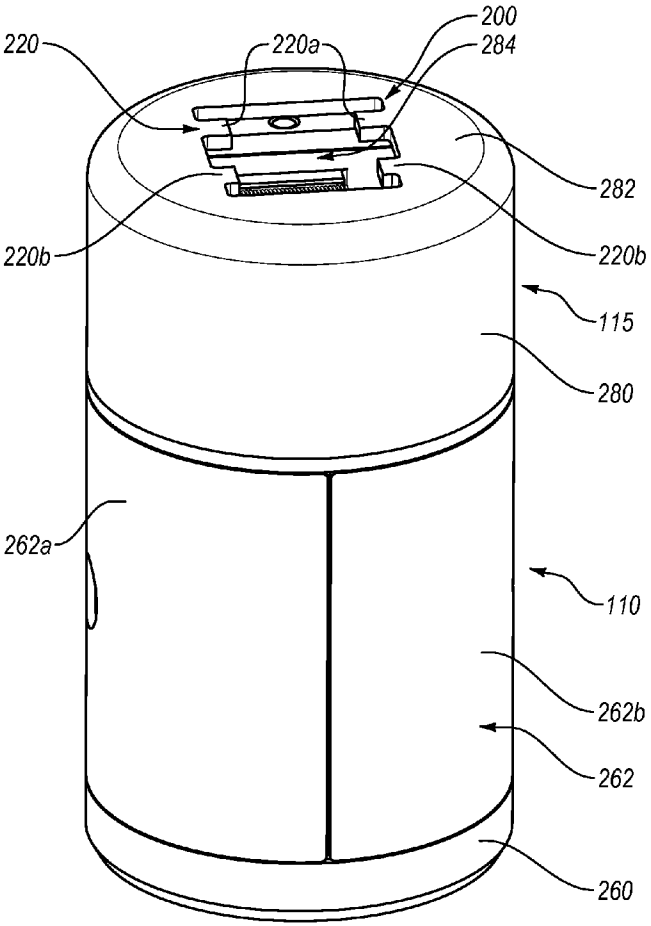
FIG. 2A is a perspective view of an embodiment of a cathode.

FIG. 2A shows the cathode assembly 110 components of the X-ray device that are arranged for electron emission and electron beam focusing. The cathode assembly 110 is shown to include a cathode bottom section 260, cathode middle section 262 composed of a first middle section 262*a* and second middle section 262*b*, and cathode head 115. The cathode head 115 includes a cathode shield 280 having a shield surface 282 with a shield aperture 284 formed therein. The cathode shield 280 forms an internal cavity therein for the cathode head 115. The cathode head 115 includes the electron emitter system 122 therein and oriented so as to emit electrons in a beam 112 towards the anode 114.

FIG. 2B shows a top view of the cathode head 115 so as look through the shield aperture 284 in order to observe the contents of the internal cavity of the cathode shield 280. The cathode shield 280 is shown to have a substantially flat shield surface 282 that is located between the emitter system 122 and the anode 114. The shield surface 282 has the focusing tab pairs 220, which are formed as the first focusing tab pair 220*a* and second focusing tab pair 220*b* that are formed into the shield aperture 284. The shield aperture 284 defines an aperture perimeter 286. The first focusing tab pair 220*a* includes the first focusing tab members 222, and the second focusing tab pair 220*b* includes the second focusing tab members 224. Each first focusing tab member 222 has a first focusing tab tip 222*a*, and each second focusing tab member 224 has a second focusing tab tip 224*a*. A first tab tip dimension exists between the first focusing tab tips 222*a*, and a second tab tip dimension exists between the second focusing tab tips 224*a*.

Figure 3A:
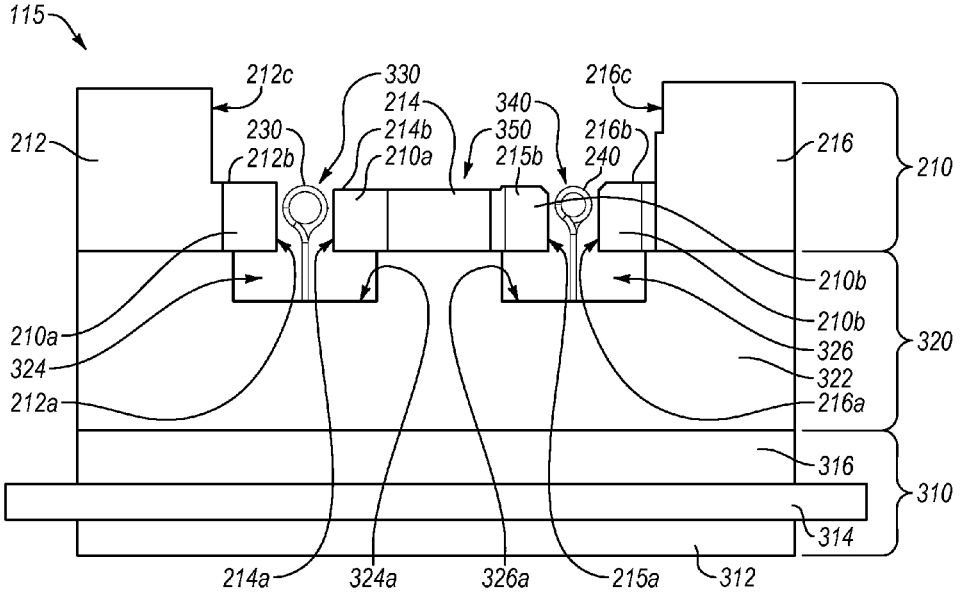
FIG. 3A is a side view of an embodiment of a cathode head.
Figure 3B:
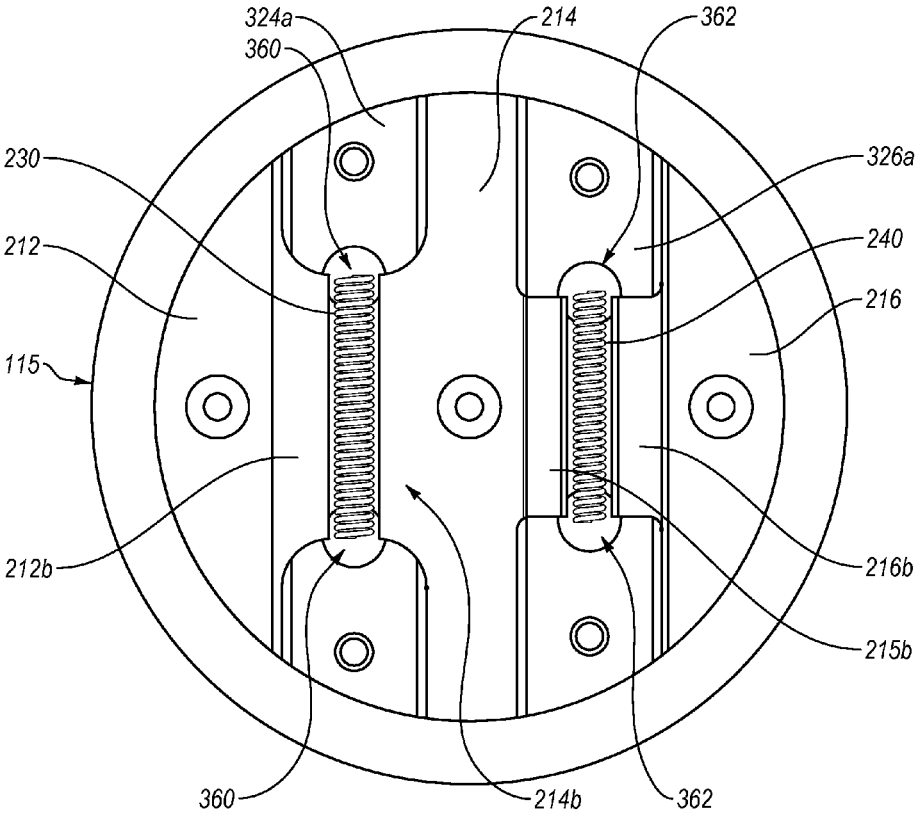
FIG. 3B is a top view of an embodiment of a cathode head.
Figure 3C:
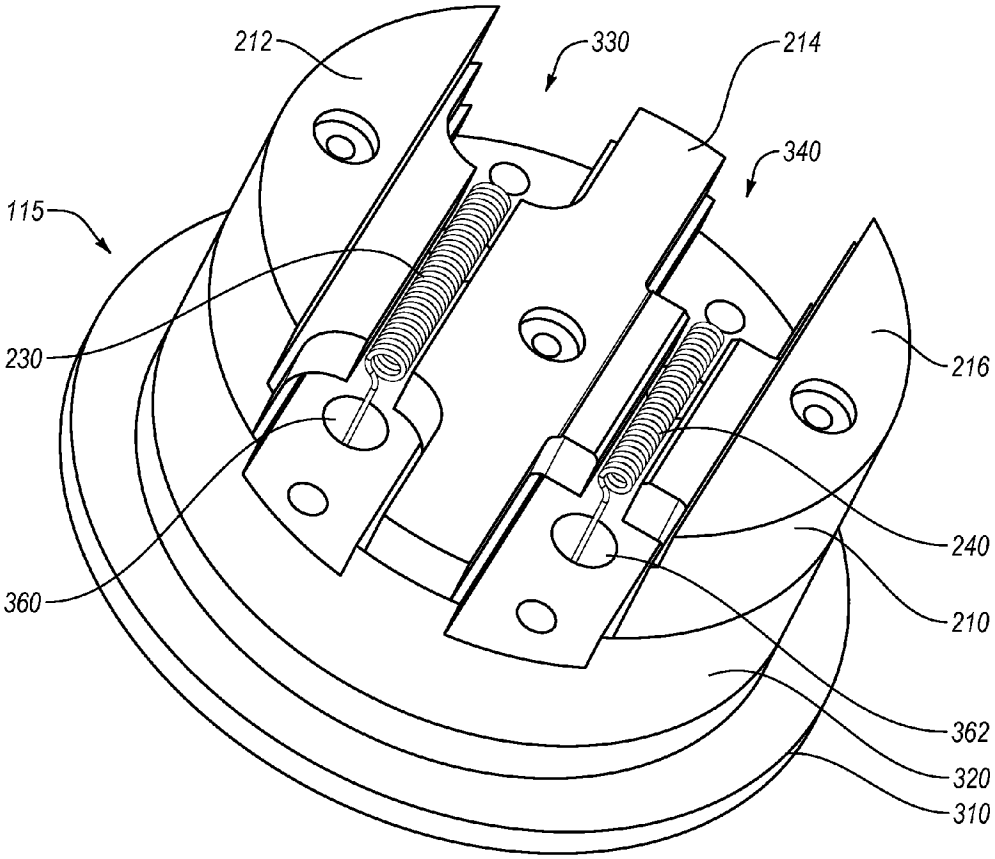
FIG. 3C is a perspective view of an embodiment of a cathode head.

FIGS. 3A-3C show the components internal of the cathode shield 280, which includes the cathode head 115. As shown are the cathode base 310, ceramic insulator 320 and focusing grid 210. The cathode base 310 includes a bottom portion 312, middle extended shelf portion 314 over the bottom portion 312 and protruding therefrom, and a top portion 316 over the middle extended shelf portion 314. The middle extended shelf portion 314 can seat the cathode shield 280.

The ceramic insulator 320 can include an insulator body 322 formed from a ceramic insulator material. The insulator body 322 can include a first filament recess 324 for a first filament 230 and a second filament recess 326 for a second filament 240. While not shown, the first filament recess 324 can include filament lead holes in a first filament recess base 324*a* that receive leads of the first filament 230 therein, such as one on each side of the first filament recess 324. While not shown, the second filament recess 326 can include filament lead holes in a second filament recess base 326*a* that receive leads of the second filament 240 therein, such as one on each side of the second filament recess 326. Accordingly, the first filament 230 extends from the first filament recess base 324*a*, and the second filament 240 extends from the second filament recess base 326*a*.

The focusing grid 210 includes a first grid member 212, second grid member 214, and third grid member 216. The combination of the first grid member 212 and second grid member 214 can be the first focusing grid pair 210*a*, and the combination of the second grid member 214 and third grid member 216 can be the second focusing grid pair 210*b*. The first grid member 212 and second grid member 214 can include a first filament slot 330 therebetween which includes the first filament 230. The third grid member 216 and second grid member 214 can include a second filament slot 340 therebetween which includes the second filament 240.

The first grid member 212 includes a first slot sidewall 212*a*, a first shelf surface 212*b*, and a first recess sidewall 212*c*. The second grid member 214 includes a first middle slot sidewall 214*a*, a first middle shelf surface 214*b*, and can optionally include a first middle recess sidewall that is not shown, and includes a second middle slot sidewall 215*a*, a second middle shelf surface 215*b*, and can optionally include a second middle recess sidewall that is not shown. The third grid member 216 includes a second slot sidewall 216*a*, a second shelf surface 216*b*, and a second recess sidewall 216*c*. The region between the first slot sidewall 212*a* and first middle slot sidewall 214*a* includes the first filament slot 330 having the first filament 230. The region between the second slot sidewall 216*a* and second middle slot sidewall 215*a* includes the second filament slot 340 having the second filament 240. The region between the first recess side wall 212*c* and second recess sidewall 216*c* can be the head recess 350, which is also defined by the first shelf surface 212*b*, first middle shelf surface 214*b*, second middle shelf surface 215*b*, and second shelf surface 216*b*.

FIG. 3B shows the holes 360, 262 in the ceramic insulator 320 configured to receive the leads of the filaments. As shown, the first filament 230 includes leads that extend into first filament lead holes 360 and the second filament 240 includes leads that extend into the second filament lead holes 362. The top view of FIG. 3B also shows the arrangement of the features therein.

Figure 4:
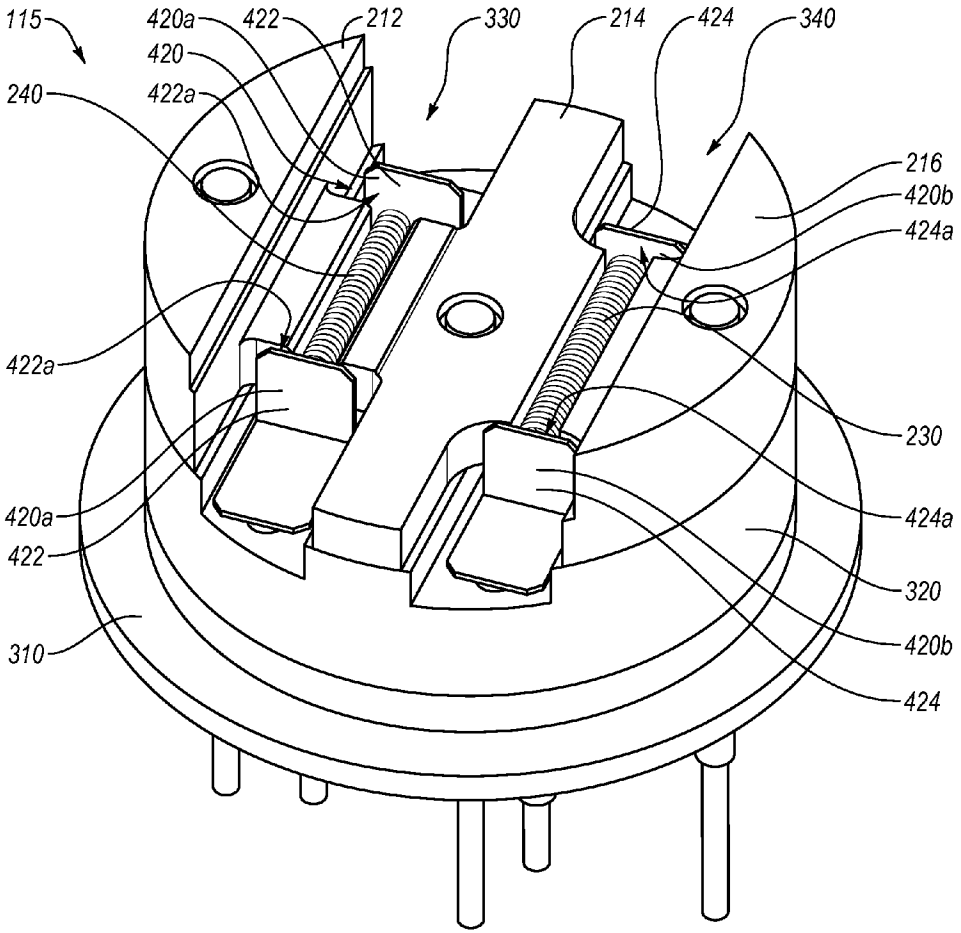
FIG. 4 is a perspective view of an embodiment of a cathode head.

FIG. 4 illustrates another embodiment of a cathode head 115, which can include the features of the cathode head 115 described herein. Additionally, the cathode head 115 includes head focusing tab pairs 420. The head focusing tab pairs 420 include the first head focusing tab pair 420*a* and second head focusing tab pair 420*b* that are mounted on or over the ceramic insulator 320. The first head focusing tab pair 420*a* includes the first head focusing tab members 422, and the second head focusing tab pair 420*b* includes the second head focusing tab members 424. Each first head focusing tab member 422 has a first head focusing tab tip 422*a*, and each second head focusing tab member 424 has a second head focusing tab tip 424*a*. A first head tab tip dimension exists between the first head focusing tab tips 422*a*, and a second head tab tip dimension exists between the second head focusing tab tips 424*a*.

Figure 5:
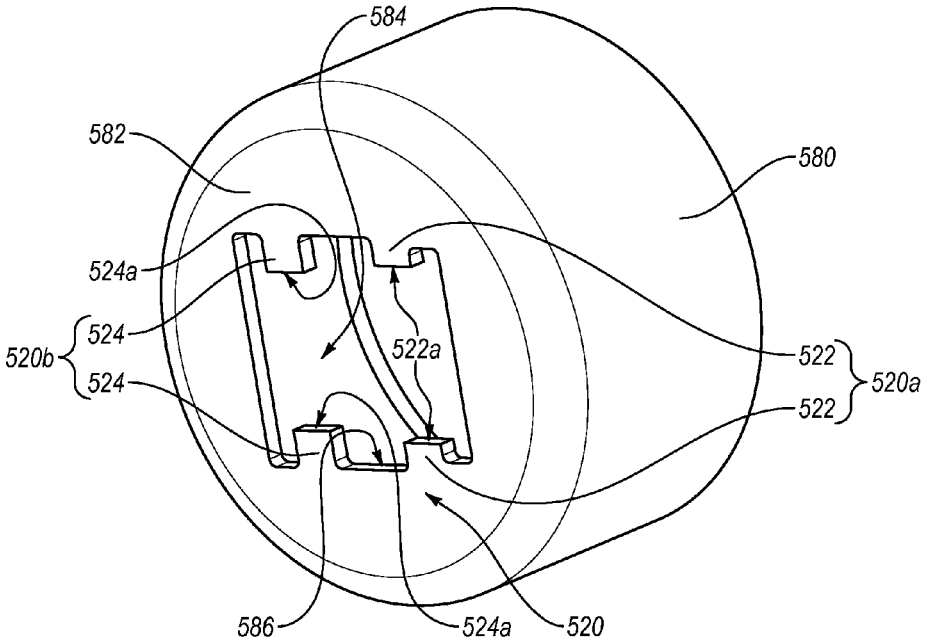
FIG. 5 is a perspective view of an embodiment of a cathode shield.

FIG. 5 illustrates an embodiment of a cathode shield 580 that has a shield aperture 584 with shield focusing tabs 520 formed therein. The cathode shield 580 is shown to have a substantially flat shield surface 582 having the shield aperture 584 therethrough that is located between the emitter system 122 and the anode 114. The shield surface 582 has the shield focusing tab pairs 520*a*, 520*b*, which are formed as the first shield focusing tab pair 520*a* and second shield focusing tab pair 520*b* that are formed into the shield aperture 584. The shield aperture 584 defines an aperture perimeter 586. The first shield focusing tab pair 520*a* includes the first shield focusing tab members 522, and the second shield focusing tab pair 220*b* includes the second shield focusing tab members 524. Each first shield focusing tab member 522 has a first shield focusing tab tip 522*a*, and each second shield focusing tab member 524 has a second shield focusing tab tip 524*a*. A first tab tip dimension exists between the first shield focusing tab tips 522*a*, and a second tab tip dimension exists between the second shield focusing tab tips 524*a*. The cathode shield 580 can be used with any of the embodiments of the cathode heads 115 provided herein, such as with those of FIGS. 3A-3C and 4. While the cathode shield 580 includes the shield focusing tabs 520, it can be used with cathode heads 115 with (FIG. 4) or without (FIGS. 3A-3C) the head focusing tabs 420.

Figure 6:
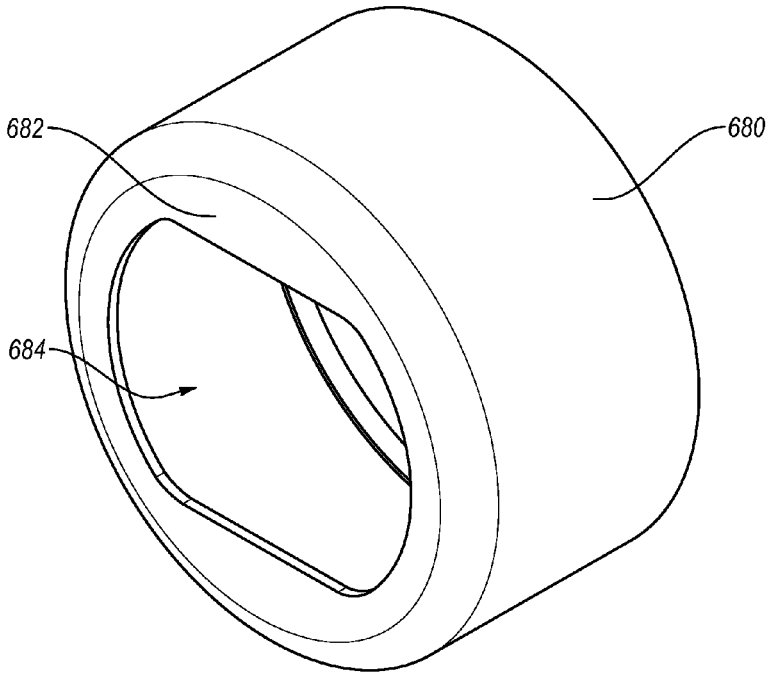
FIG. 6 is a perspective view of an embodiment of a cathode shield.

FIG. 6 illustrates an embodiment of a cathode shield 680 that has a shield aperture 684 without any shield focusing tabs formed therein. The cathode shield 680 is shown to have a substantially flat shield surface 682 having the shield aperture 684 therethrough that is located between the emitter system 122 and the anode 114. The cathode shield 680 can be used with any of the embodiments of the cathode heads 115 provided herein, such as with those of FIGS. 3A-3C and 4. While the cathode shield 680 does not include any shield focusing tabs, it can be used with cathode heads 115 with (FIG. 4) or without (FIGS. 3A-3C) the head focusing tabs 420. As such, the X-ray tube may include or omit the head focusing tabs 420, and thereby focusing can be performed with only the focusing grids. However, it can be preferred that the X-ray include either the head focusing tabs 420 or the shield focusing tabs 520, and thereby the cathode shield 680 preferably is used with the cathode head 115 of FIG. 4.

Figure 7A:
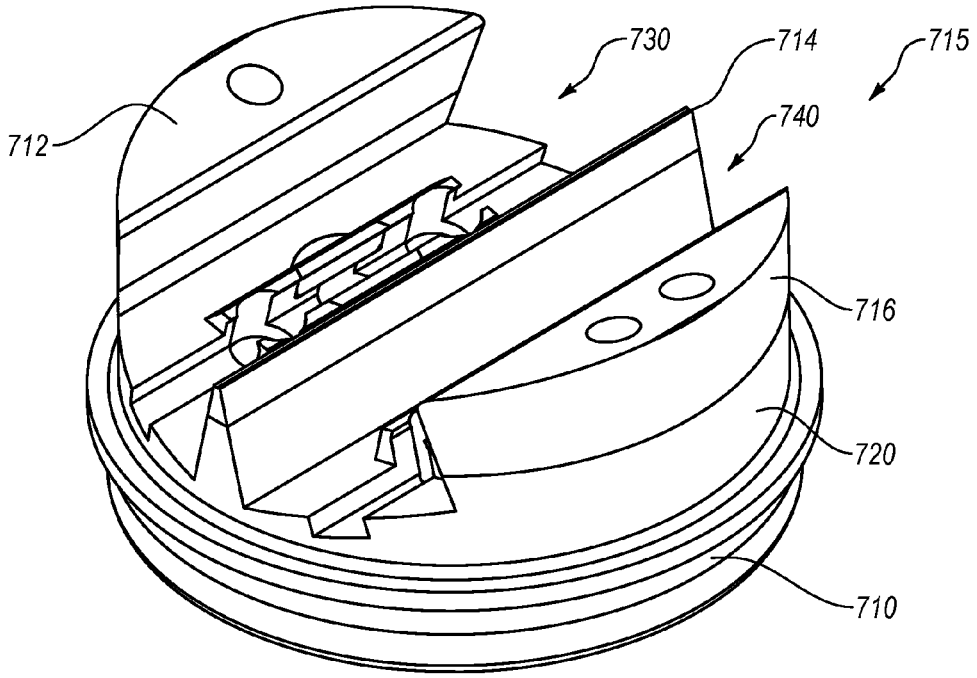
FIG. 7A is perspective view of an embodiment of a cathode head.
Figure 7B:
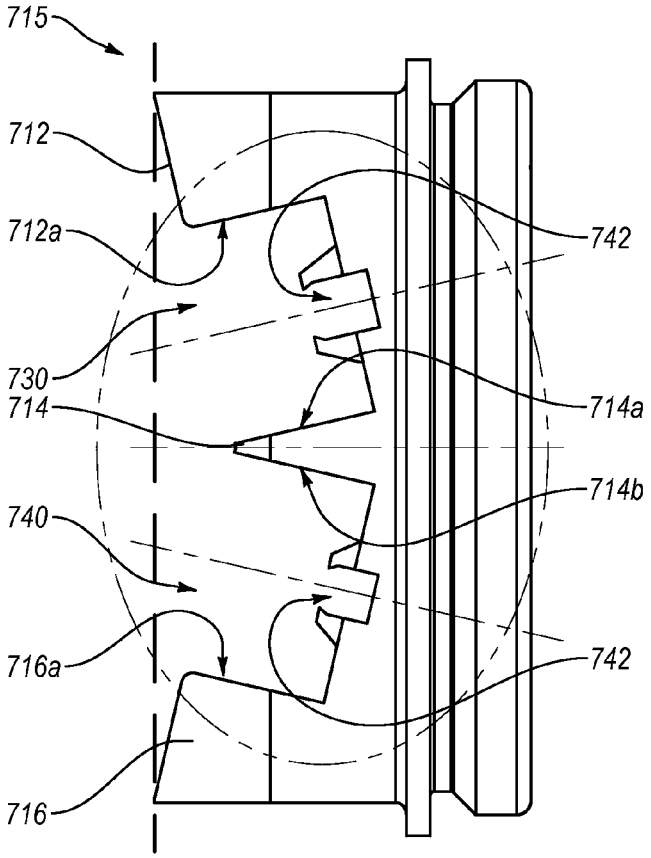
FIG. 7B is a side view of an embodiment of a cathode head.

FIG. 7A illustrates an embodiment of a cathode head 715 that includes angled filament slots 730, 740. Here, the filament slots 730, 740 are angled so as to point toward a common target. While there is a representative angle, the angle can be any angle between 90 degrees and 45 degrees, and possibly even lower angles. The angle can be defined with respect to the cathode head plane (e.g., dashed line FIG. 7B) or the electron beam. The cathode head 715 still includes the cathode base 710 and ceramic insulator 720 with the first focusing grid 712, second focusing grid 714 (e.g., middle grid), and third focusing grid 716. The first focusing grid 712 includes the first sidewall 712*a*, the second focusing grid 714 includes a first middle sidewall 714*a* and second middle sidewall 714*b*, and the third focusing grid 716 includes a second sidewall 716*a*. The region between the first sidewall 712*a* and the first middle sidewall 714*a* includes the first filament slot 730 having the first filament 230. The region between the second sidewall 716*a* and the second middle sidewall 714*b* includes the second filament slot 740 having the second filament 240. Also, the bottom of the first filament slot 730 may have a first filament recess 732 that retains the first filament 230, and the bottom of the second filament slot 740 may have a second filament recess 742 that retains the second filament 240. The first sidewall 712*a* and first middle sidewall 714*a* may have the same angle with respect to the cathode head plane, and the second sidewall 716*a* and second middle sidewall 714*b* may have the same angle with respect to the cathode head plane. Accordingly, the filament slots 730, 740 can each have a defined angle with respect to the cathode head plane, which can be the same or different. The first filament recess 732 and second filament recess 742 may also have these angles, or different angles. The first filament slot 730 and second filament slot 740 are not parallel. While not shown, the cathode head 715 may also include head focusing tabs similarly arranged as shown in FIG. 4. The cathode head 715 may also be used with the cathode shield of either FIG. 5 (e.g., with focusing tabs) or FIG. 6 (e.g., without focusing tabs).

Figure 8:
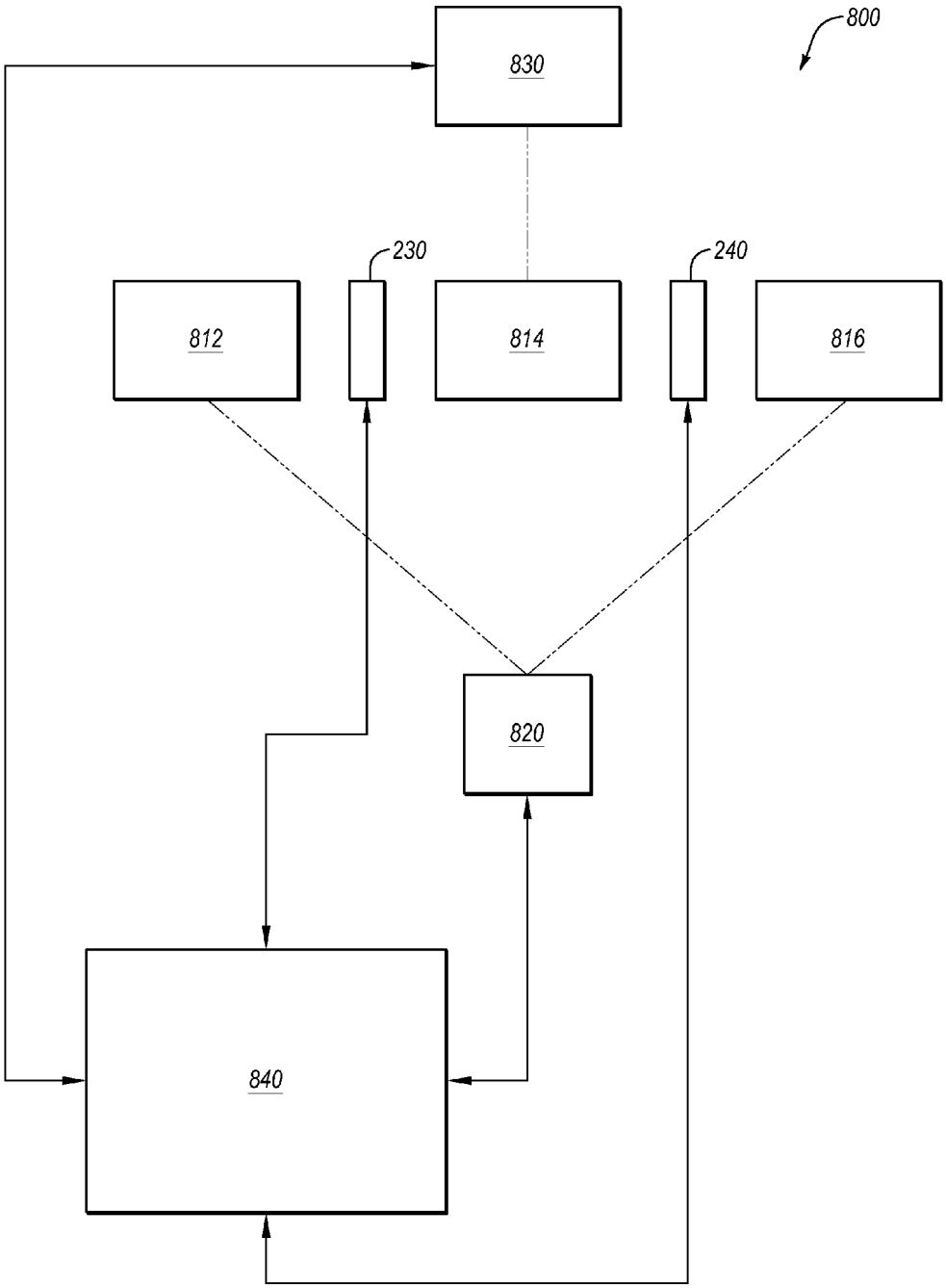
FIG. 8 is a schematic representation of an embodiment of a power and control system for operating a cathode head.

FIG. 8 illustrates a schematic of a voltage control system 800 for the X-ray tubes described herein. The voltage control system 800 includes the first grid member 812, second grid member 814, and third grid member 816. The first coil filament 230 is between the first grid member 812 and second grid member 814. The second coil filament 240 is between the second grid member 814 and third grid member 816. The first grid member 812 and third grid member 816 are electrically coupled with a first voltage controller 820, which is configured to provide the same voltage to both the first grid member 812 and third grid member 816. The second grid member 814 is electrically coupled to a second voltage controller 830, which is configured to provide voltage to the second grid member 814. The first voltage controller 820 and second voltage controller 830 are operably coupled with a central controller 840 that can provide commands to the first voltage controller 820 and second voltage controller 830 with regard to when voltages are supplied as well as the magnitude of the voltages. Also, the central controller 840 can function as a switch so as to switch between the first voltage controller 820 and second voltage controller 830 so that only one of them is providing voltage at a time. The central controller 840 may also be operably coupled to the first coil filament 230 and second coil filament 240 in order to control the voltage thereof as well as control which filament is electrified and emitting electrons at a point in time. In operation, the first coil filament 230 will emit an electron beam, or the second coil filament 240 will emit the electron beam. During such electron beam emission, the central controller 840 can control the coil filaments, and control the voltages of the first voltage controller 820 and second voltage controller 830. In one aspect, a user can input the voltages for the first voltage controller 820 and second voltage controller 830 into the central controller.

In one embodiment, the coil filament electron emitters can be comprised of a tungsten wire, although other materials can be used. Alloys of tungsten and other tungsten variants can be used. Also, the emitting surface can be coated with a composition that reduces the material work function, which makes emission occur at a lower temperature. For example, the coating can be tungsten, tungsten alloys, thoriated tungsten, doped tungsten (e.g., potassium doped), zirconium carbide mixtures, barium mixtures or other coatings can be used to decrease the emission temperature. Any known emitter material or emitter coating, such as those that reduce emission temperature, can be used for the emitter material or coating. Examples of suitable materials are described in U.S. Pat. No. 7,795,792 entitled "Cathode Structures for X-ray Tubes," which is incorporated herein in its entirety by specific reference.

In one embodiment, the grid members can be configured as electrodes so as to be electrically conductive, and can be prepared from materials commonly used for electrodes. For example, the grid members can be prepared from nickel or stainless steel.

In one embodiment, the tab members can be configured as electrodes, and can be prepared from materials commonly used for electrodes so as to be electrically conductive. For example, the tab members can be prepared from nickel or stainless steel. As such, the cathode shield can be prepared from such materials, and the head tab members can be prepared from such materials.

In one embodiment, a cathode head can include: a first electron emitter filament having a first size; a first grid pair defining walls of a first filament slot having the first electron emitter filament therein, each grid member of the first grid pair being electronically coupled to different voltage sources; a second electron emitter filament having a different second size spaced apart from the first electron emitter filament; and a second grid pair defining walls of a second filament slot having the first electron emitter therein, each grid member of the second grid pair being electronically coupled to different voltage sources. In one aspect, the first grid pair has a first grid member and a second grid member; and the second grid pair has the second grid member and a third grid member. In one aspect, the first grid member and third grid member are electronically coupled to the same voltage source and the second grid member being electronically coupled to a different voltage source.

In one embodiment, a cathode head can include: a cathode base; a ceramic insulator on the cathode base; and the first grid member, second grid member, and third grid member on the ceramic insulator so as to be spaced apart from each other.

In one embodiment, a cathode head can include: a first tab pair associated with the first electron emitter filament so that electrons emitted from the first electron emitter pass between the first tab pair; and a second tab pair associated with the second electron emitter filament so that electrons emitted from the second electron emitter pass between the second tab pair.

In one embodiment, a cathode head can include: each tab member of the first tab pair being located at opposite ends of the first electron emitter filament and each grid member of the first grid pair being located at opposite sides of the first electron emitter filament; and each tab member of the second tab pair being located at opposite ends of the second electron emitter filament and each grid member of the second grid pair being located at opposite sides of the second electron emitter filament.

In one embodiment, the first tab pair includes a first tab member and a second tab member, and the second tab pair includes a third tab member and a fourth tab member.

In one embodiment, a cathode head can include the first tab pair and second tab pair both located on a ceramic insulator so as to be electronically isolated from the first and second grid pairs and are both electronically coupled to a cathode base that is grounded.

In one embodiment, a cathode head can include a cathode shield defining a shield cavity containing the first and second electron emitter filaments and first and second grid pairs, and defining a shield aperture having the first and second tab pairs formed into a perimeter of the shield aperture.

In one embodiment, a cathode head can include: a cathode base; a ceramic insulator on the cathode base so as to form a cathode base annular ring protruding outwardly from the ceramic insulator; a first grid member, second grid member, and third grid member on the ceramic insulator so as to be spaced apart from each other, the first grid pair having the first grid member and second grid member, and the second grid pair having the second grid member and the third grid member; and the cathode shield coupled with the cathode base annular ring.

In one embodiment, the first filament slot and second filament slot having walls that are parallel in the electron emission direction. In one aspect, the first filament slot and second filament slot can have walls that are angled in the electron emission direction so that first filament slot and second filament slot open toward a common focal spot.

In one embodiment, an X-ray tube can include the cathode head of any of the embodiments, and an anode spaced apart from the cathode head.

In one embodiment, an X-ray device can include: the X-ray tube having the cathode head; a first voltage source; a second voltage source; and the first grid pair having a first grid member and a second grid member, the second grid pair having the second grid member and a third grid member, wherein the first grid member and third grid member are electronically coupled to the first voltage source and the second grid member being electronically coupled to the second voltage source.

In one embodiment, a method of manufacturing a cathode head can include: forming a cathode base; forming a ceramic insulator on the cathode base; forming a primary grid member on the ceramic insulator; and forming two filament slots through the primary grid member to the ceramic insulator so as to form three separate focusing grid members from the grid member, with one filament slot between adjacent and separate focusing grid members. In one aspect, the method can include brazing the cathode base to the ceramic insulator, and brazing the ceramic insulator to the primary grid member grid member. In one aspect, the method can include the formation of the two filament slots being by EDM. In one aspect, the method can include providing the ceramic insulator having two filament recesses preformed therein prior to being bonded to the primary grid member. In one aspect, the method can include forming the two filament slots so as to reveal the two preformed filament recesses in the ceramic insulator. In one aspect, the method can include coupling a cathode shield to the cathode base so as to be electrically coupled thereto so as to form a cathode shield cavity containing coil filaments in the two filament slots.

In one embodiment, a method of emitting electrons from a cathode to an anode can include: emitting electrons as a first electron beam from a first coil filament; focusing the first electron beam with a first focusing grid pair; ceasing electron emission from the first coil filament; emitting electrons as a second electron beam from a second coil filament; focusing the second electron beam with a second focusing grid pair; and ceasing electron emission from the second coil filament. In one aspect, the method can include emitting electrons from only one of the first or second coil filament at a time. In one aspect, the method can include steering the first electron beam from a first focal spot to a second focal spot with the first focusing grid pair; or steering the second electron beam from a third focal spot to a fourth focal spot with the second focusing grid pair. In one aspect, the method can include gating the first electron beam from reaching the anode with the first focusing grid pair; or gating the second electron beam from reaching the anode with the second focusing grid pair. In one aspect, the method can include focusing the first electron beam with a first focusing tab pair in a focusing direction orthogonal to the focusing by the first focusing grid pair; and focusing the second electron beam with a second focusing tab pair in a focusing direction orthogonal to the focusing by the second focusing grid pair.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

All references recited herein are incorporated herein by specific reference in their entirety.

The invention claimed is:

1. A cathode head comprising:

a cathode base:

a first electron emitter filament above the cathode base having a first size;

a first grid pair above the cathode base defining walls of a first filament slot having the first electron emitter filament therein, each grid member of the first grid pair being electronically coupled to different voltage sources;

a second electron emitter filament above the cathode base having a different second size spaced apart from the first electron emitter filament;

a second grid pair above the cathode base defining walls of a second filament slot having the second electron emitter therein, each grid member of the second grid pair being electronically coupled to different voltage sources;

a first focusing tab pair, each focusing tab member of the first focusing tab pair having a first focusing tab tip, the first electron emitter filament being between the cathode base and each first focusing tab tip, each first focusing tab tip being associated with the first electron emitter filament so that electrons emitted from the first electron emitter pass between and are focused by the first focusing tab pair; and a second focusing tab pair, each focusing tab member of the second focusing tab pair having a second focusing tab tip, the second electron emitter filament being between the cathode base and each second focusing tab tip, each second focusing tab tip being associated with the second electron emitter filament so that electrons emitted from the second electron emitter pass between and are focused by the second focusing tab pair;

wherein each tab member of the first tab pair being located at opposite ends of the first electron emitter filament; and each tab member of the second tab pair being located at opposite ends of the second electron emitter filament.

2. The cathode of claim 1, comprising:

the first grid pair having a first grid member and a second grid member; and the second grid pair having the second grid member and a third grid member.

3. The cathode of claim 2, comprising the first grid member and third grid member are electronically coupled to the same voltage source and the second grid member being electronically coupled to a different voltage source.

4. The cathode of claim 1, comprising:

a cathode base;

a ceramic insulator on the cathode base; and the first grid member, second grid member, and third grid member on the ceramic insulator so as to be spaced apart from each other.

5. The cathode of claim 1, comprising:

each tab member of the first tab pair being located at opposite ends of the first electron emitter filament and each grid member of the first grid pair being located at opposite sides of the first electron emitter filament; and each tab member of the second tab pair being located at opposite ends of the second electron emitter filament and each grid member of the second grid pair being located at opposite sides of the second electron emitter filament.

6. The cathode of claim 1, comprising:

each grid member of the first grid pair being located at opposite sides of the first electron emitter filament; and each grid member of the second grid pair being located at opposite sides of the second electron emitter filament.

7. The cathode of claim 5, wherein the first tab pair and second tab pair are both located on a ceramic insulator so as to be electronically isolated from the first and second grid pairs and are both electronically coupled to a cathode base that is at a reference voltage.

8. The cathode of claim 1, comprising:

a cathode shield defining a shield cavity containing the first and second electron emitter filaments and first and second grid pairs, and defining a shield aperture having the first and second tab pairs formed into a perimeter of the shield aperture.

9. The cathode of claim 8, comprising:

a cathode base;

a ceramic insulator on the cathode base so as to form a cathode base annular ring protruding outwardly from the ceramic insulator;

a first grid member, second grid member, and third grid member on the ceramic insulator so as to be spaced apart from each other, the first grid pair having the first grid member and second grid member, and the second grid pair having the second grid member and the third grid member; and the cathode shield coupled with the cathode base annular ring.

10. The cathode of claim 1, comprising the first filament slot and second filament slot having walls that are parallel.

11. The cathode of claim 1, comprising the first filament slot and second filament slot having walls that are angled so that first filament slot and second filament slot open toward a common focal spot.

12. An X-ray tube comprising:

the cathode head of claim 1; and an anode spaced apart from the cathode head.

13. An X-ray device comprising:

the X-ray tube of claim 12;

a first voltage source;

a second voltage source; and the first grid pair having a first grid member and a second grid member, the second grid pair having the second grid member and a third grid member, wherein the first grid member and third grid member are electronically coupled to the first voltage source and the second grid member being electronically coupled to the second voltage source.

14. A method of manufacturing the cathode head of claim 1, the method comprising:

forming the cathode base;

forming a ceramic insulator on the cathode base;

forming a primary grid member on the ceramic insulator; and forming two filament slots through the primary grid member to the ceramic insulator so as to form three separate focusing grid members from the grid member, with one filament slot between adjacent and separate focusing grid members.

15. The method of claim 14, comprising:

brazing the cathode base to the ceramic insulator; and brazing the ceramic insulator to the primary grid member grid member.

16. The method of claim 14, wherein the formation of the two filament slots is by EDM.

17. The method of claim 14, comprising providing the ceramic insulator having two filament recesses preformed therein prior to being bonded to the primary grid member.

18. The method of claim 17, wherein forming the two filament slots reveals the two preformed filament recesses in the ceramic insulator.

19. The method of claim 14, comprising coupling a cathode shield to the cathode base so as to be electrically coupled thereto so as to form a cathode shield cavity containing coil filaments in the two filament slots.

20. A method of emitting electrons from a cathode to an anode, the method comprising:

providing the cathode head of claim 1;

emitting electrons as a first electron beam from the first electron emitter filament;

focusing the first electron beam with the first grid pair;

ceasing electron emission from the first electron emitter filament;

emitting electrons as a second electron beam from the second electron emitter filament;

focusing the second electron beam with the second grid pair; and ceasing electron emission from the second electron emitter filament.

21. The method of claim 20, comprising emitting electrons from only one of the first or second electron emitter filament at a time.

22. The method of claim 20 comprising:

steering the first electron beam from a first focal spot to a second focal spot with the first grid pair; or steering the second electron beam from a third focal spot to a fourth focal spot with the second grid pair.

23. The method of claim 20 comprising:

gating the first electron beam from reaching the anode with the first grid pair; or gating the second electron beam from reaching the anode with the second grid pair.

24. The method of claim 20, comprising:

focusing the first electron beam with the first focusing tab pair in a focusing direction orthogonal to the focusing by the first grid pair; and focusing the second electron beam with the second focusing tab pair in a focusing direction orthogonal to the focusing by the second grid pair.

* * * * *